US011708671B2

(12) United States Patent
Wang et al.

(10) Patent No.: US 11,708,671 B2
(45) Date of Patent: Jul. 25, 2023

(54) INSTALLATION METHOD OF BENT CAP FOR MUTUALLY RESTRAINING ADJACENT PIER STUDS IN PREFABRICATED AND ASSEMBLED BRIDGE

(71) Applicant: CHINA TIESIJU CIVIL ENGINEERING GROUP CO., LTD., Anhui (CN)

(72) Inventors: Jiaqing Wang, Anhui (CN); Dachuang Yao, Anhui (CN); Lijun Jin, Anhui (CN); Xinghuo Xu, Anhui (CN); Shisheng Fang, Anhui (CN); Zhenye Zhu, Anhui (CN); Tao Xu, Anhui (CN); Hao Ren, Anhui (CN); Jinmiao Xu, Anhui (CN); Biao Xing, Anhui (CN); Shoufeng Zhang, Anhui (CN)

(73) Assignee: CHINA TIESIJU CIVIL ENGINEERING GROUP CO., LTD., Anhui (CN)

( * ) Notice: Subject to any disclaimer, the term of this patent is extended or adjusted under 35 U.S.C. 154(b) by 260 days.

(21) Appl. No.: 17/416,526

(22) PCT Filed: Dec. 15, 2020

(86) PCT No.: PCT/CN2020/136425
§ 371 (c)(1),
(2) Date: Jun. 21, 2021

(87) PCT Pub. No.: WO2021/196739
PCT Pub. Date: Oct. 7, 2021

(65) Prior Publication Data

US 2022/0220677 A1 Jul. 14, 2022

(30) Foreign Application Priority Data

Apr. 3, 2020 (CN) ..... 202010261163.0

(51) Int. Cl.
*E01D 19/00* (2006.01)
*E01D 19/02* (2006.01)
*E01D 21/00* (2006.01)

(52) U.S. Cl.
CPC ..... *E01D 19/02* (2013.01); *E01D 21/00* (2013.01)

(58) Field of Classification Search
CPC ..... E01D 19/02; E01D 21/00
(Continued)

(56) References Cited

U.S. PATENT DOCUMENTS 4,910,940 A * 3/1990 Grady, II ..... E04B 5/08 52/223.5
5,826,387 A * 10/1998 Henderson ..... E02D 27/42 405/251

(Continued)

FOREIGN PATENT DOCUMENTS

CN 105803925 7/2016
CN 106049259 10/2016

(Continued)

OTHER PUBLICATIONS

"International Search Report (Form PCT/ISA/210) of PCT/CN2020/136425," dated Mar. 18, 2021, pp. 1-5.

*Primary Examiner* — Raymond W Addie
(74) *Attorney, Agent, or Firm* — JCIP Global Inc.

(57) ABSTRACT

An installation method of a bent cap for mutually restraining adjacent pier studs in a prefabricated and assembled bridge is provided. A bent cap mold base is configured in a form of a bent cap, which includes fixedly arranging limiting steel rings at two ends of a rectangular frame and vertically arranging steel bar sleeves in the limiting steel rings, hoisting the cap bent mold base on top portions of adjacent two prefabricated pier studs, such that pier stud pre-embedded steel bars protruding from the top portions of the two (Continued)

prefabricated pier studs are correspondingly inserted into the steel bar sleeves at two ends of the bent cap mold base one by one, and limiting the adjacent two prefabricated pier studs in the bent cap mold base.

8 Claims, 5 Drawing Sheets

(58) Field of Classification Search
USPC ..... 14/73–78
See application file for complete search history.

(56) References Cited

U.S. PATENT DOCUMENTS 7,546,656 B2 * 6/2009 Kim ..... E01D 2/00 14/77.3
7,618,217 B2 * 11/2009 Henderson ..... E02D 27/12 52/294
8,006,339 B1 * 8/2011 Bennett ..... E01D 19/042 384/36
8,341,788 B2 * 1/2013 Kim ..... E01D 19/00 14/77.3
8,910,336 B2 * 12/2014 Han ..... E01D 19/00 14/77.3
11,427,975 B2 * 8/2022 Wang ..... E01D 19/02
2002/0073876 A1 * 6/2002 Einar ..... B61B 13/04 104/124

FOREIGN PATENT DOCUMENTS

CN 107100078 8/2017
CN 111305082 6/2020
KR 20130102898 9/2013

* cited by examiner

INSTALLATION METHOD OF BENT CAP FOR MUTUALLY RESTRAINING ADJACENT PIER STUDS IN PREFABRICATED AND ASSEMBLED BRIDGE

CROSS-REFERENCE TO RELATED APPLICATION

This application is a 371 of international application of PCT application serial no. PCT/CN2020/136425, filed on Dec. 15, 2020, which claims priority to and the benefit of China Patent Application No. 202010261163.0, filed on Apr. 3, 2020. The entirety of each of the above-mentioned patent applications is hereby incorporated by reference herein and made a part of this specification.

BACKGROUND

Technical Field

The disclosure relates to a construction field of prefabricated and assembled bridges, and in particular, relates to an installation and construction method for pier studs and bent caps in a prefabricated and assembled bridge in highway bridge engineering.

Description of Related Art

At present, fully assembled bridges are becoming the development trend of bridge construction. The pier studs, bent caps, and other components are prefabricated in factory and assembled on site, and in this way, the level of mechanized operation may be significantly improved, and the construction progress is accelerated while improving quality. Further, the improvement of construction efficiency of the fully assembled bridges may greatly reduce the interference to traffic and is beneficial to environmental protection as well.

Regarding the installation and construction of prefabricated and assembled pier studs and bent caps in highway bridge engineering, the bent cap construction is carried out after the pier studs are fixed. The accuracy of the spatial position and state of the pier studs are important for the installation quality of the prefabricated bent caps. Regarding the prefabricated pier studs, accurate positioning is required so that the accuracy of spatial position of the pier studs may be ensured. Nevertheless, in the related art, it is difficult to ensure the degree of matching between the pier studs and the bent caps in a construction method in which each single stud of the prefabricated pier studs is individually adjusted and installed one by one. Once installation deviation occurs in the prefabricated pier studs, the bent caps may not be aligned and installed, which may greatly increase the construction costs and delay the construction period due to rework.

SUMMARY

Summary of Disclosure

In order to prevent the problems found in the related art from occurring, the disclosure provides an installation method of a bent cap for mutually restraining adjacent pier studs in a prefabricated and assembled bridge with an aim to improve construction efficiency of bent cap installation and ensure engineering quality.

The technical solution adopted by the disclosure includes the following.

The disclosure provides an installation method of a bent cap for mutually restraining adjacent pier studs in a prefabricated and assembled bridge.

The pier studs are prefabricated pier studs, and a top portion of each of the prefabricated pier studs is provided with pier stud pre-embedded steel bars. The pier stud pre-embedded steel bars are evenly distributed into a circular ring shape on the top portion of each of the prefabricated pier studs and form a pier stud pre-embedded steel bar ring with a radius r.

The bent cap is a prefabricated bent cap, and two ends of the prefabricated bent cap are pre-embedded with bent cap pre-embedded sleeves. Vertical grouting ducts are provided on a top portion of the prefabricated bent cap to communicate with the bent cap pre-embedded sleeves. The bent cap pre-embedded sleeves on the two ends of the prefabricated bent cap are evenly distributed into a circular ring shape at each end to form a bent cap pre-embedded sleeve ring with a radius r.

The bent cap pre-embedded sleeves in the bent cap pre-embedded sleeve ring correspond to the pier stud pre-embedded steel bars in the pier stud pre-embedded steel bar ring one to one, such that the pier stud pre-embedded steel bars may be inserted into the bent cap pre-embedded sleeves of corresponding positions for anchorage.

A bent cap mold base is configured as follows.

Limiting steel rings are fixedly arranged at two ends of a rectangular frame, and steel bar sleeves are vertically arranged in the limiting steel rings. The steel bar sleeves are evenly distributed into a circular ring shape in each limiting steel ring and form a steel bar sleeve ring with a radius r. A center-to-center distance of the steel bar sleeve rings at the two ends and a center-to-center distance of the bent cap pre-embedded sleeve rings at the two ends in the prefabricated bent cap are set to be identical. Positions of the steel bar sleeves in the steel bar sleeve ring are set to correspond to positions of the bent cap pre-embedded sleeves in the bent cap pre-embedded sleeve ring of the corresponding end one to one.

The installation method of the bent cap is performed in constructed pile top cup bearing platforms through the following steps.

In step 1, through hoisting, the prefabricated pier studs are placed in two adjacent pile top cup bearing platforms, and a center distance and a plane position between the two prefabricated pier studs are preliminarily adjusted.

In step 2: the cap bent mold base is hoisted on the top portions of the two prefabricated pier studs, such that the pier stud pre-embedded steel bars protruding from the top portions of the two prefabricated pier studs are correspondingly inserted into the steel bar sleeves at two ends of the bent cap mold base one by one. If the pier stud pre-embedded steel bars in the two prefabricated pier studs and the steel bar sleeves at the two ends of the bent cap mold base are not aligned due to deviation, the prefabricated pier studs are lifted again by a crane, the center distance and/or the plane position between the two prefabricated pier studs are readjusted until the pier stud pre-embedded steel bars in the two prefabricated pier studs are correspondingly inserted into the vertical steel bar sleeves at the two ends of the bent cap mold base one by one, such that the adjacent two prefabricated pier studs are limited in the bent cap mold base.

In step 3, heights and perpendicularity of the adjacent two prefabricated pier studs are adjusted to satisfy design needs, and the prefabricated pier studs are kept in a state which satisfies the design needs.

In step 4, anchorage is performed between each of the pile top cup bearing platforms and the corresponding prefabricated pier stud to complete assembly of the prefabricated pier studs.

In step 5, the bent cap mold base is removed, the bent cap mold base is replaced with the bent cap, and the pier stud pre-embedded steel bars protruding from the top portions of the prefabricated pier studs are inserted into the bent cap pre-embedded sleeves pre-embedded in the bent cap one by one.

In step 6, grouting is performed through the grouting ducts on the bent cap, anchorage is performed between the prefabricated pier studs and the prefabricated bent cap, and assembly of the prefabricated bent cap is completed.

The installation method of the bent cap for mutually restraining the adjacent pier studs in the prefabricated and assembled bridge provided by the disclosure further includes the following.

In step 3, an auxiliary adjustment mechanism is arranged to adjust the height and perpendicularity of each prefabricated pier stud, and a structure of the auxiliary adjustment mechanism is provided as follows.

Top support mechanisms are arranged between a top surface of each pile top cup bearing platform and an outer side wall of each prefabricated pier stud. The top support mechanisms are evenly distributed in at least three groups around the outer side wall of the prefabricated pier stud. Each group of the top support mechanisms may independently adjust a top support height thereof, and adjustment of the height and/or perpendicularity of the pier stud is achieved through adjusting the top support height of the top support mechanisms of one group or plural groups.

The installation method of the bent cap for mutually restraining the adjacent pier studs in the prefabricated and assembled bridge provided by the disclosure further includes the following. A structure of each of the top support mechanisms is that: a jack is provided on the top surface of each pile top cup bearing platform. A reaction frame with a horizontal support surface is provided on a corresponding position of the outer side wall of each prefabricated pier stud, and the jack is supported between the top surface of the pile top cup bearing platform and the support surface of the reaction frame.

The installation method of the bent cap for mutually restraining the adjacent pier studs in the prefabricated and assembled bridge provided by the disclosure further includes the following. The reaction frame is formed by a vertical universal beam and a horizontal universal beam. The vertical universal beam is attached to the outer side wall of the prefabricated pier stud and is attached to the outer side wall of the prefabricated pier stud through flange slabs separately disposed on two sides of a web of the vertical universal beam. One end of the horizontal universal beam abuts against the web of the vertical universal beam and is fixedly connected to the vertical universal beam, and a bottom surface of a lower flange slab in the horizontal universal beam is the support surface of the reaction frame.

The installation method of the bent cap for mutually restraining the adjacent pier studs in the prefabricated and assembled bridge provided by the disclosure further includes the following. A fixed structure of the arranged reaction frame is that: a web reserved hole is provided on the web of the vertical universal beam. Pier stud reserved holes are radially and horizontally arranged in each prefabricated pier stud. One end of a steel rod is inserted into one of the pier stud reserved holes, and the other end of the steel rod penetrates through the web reserved hole in the vertical universal beam and is disposed on a top surface of an upper flange slab of the horizontal universal beam.

The installation method of the bent cap for mutually restraining the adjacent pier studs in the prefabricated and assembled bridge provided by the disclosure further includes the following. The fixed structure of the reaction frame is further provided with a lower-layer fixed structure formed by: a lower-layer web reserved hole, lower-layer pier stud reserved holes, and a lower-layer steel rod. The lower-layer fixed structure is located at a position that does not interfere with the horizontal universal beam. One end of the lower-layer steel rod is inserted into one of the lower-layer pier stud reserved holes of the prefabricated pier stud, and the other end of the lower-layer steel rod is directly disposed in the lower-layer web reserved hole in the vertical universal beam.

The installation method of the bent cap for mutually restraining the adjacent pier studs in the prefabricated and assembled bridge provided by the disclosure further includes the following.

Performing anchorage between each of the pile top cup bearing platforms and the corresponding prefabricated pier stud in step 4 further includes the following steps.

A pier stud metal bellow is pre-embedded on an outer circumferential surface of a lower section of the prefabricated pier stud, and a pier stud installation section whose outer circumferential surface is bellow-shaped is formed.

In a cup mouth of each pile top cup bearing platform, a cup metal bellow is pre-embedded on a wall surface of a stud chamber, and a socket whose stud chamber wall surface is bellow-shaped is formed. A central steel pad is pre-embedded on a bottom surface of the stud chamber.

The pier stud installation section is placed in the socket, an annular grouting chamber is formed between circumferential surfaces of each other, and a bottom plane grouting chamber is formed on a bottom surface. A high-strength grouting material is injected in the annular grouting chamber and the bottom plane grouting chamber to achieve the anchorage between the pile top cup bearing platform and the corresponding prefabricated pier stud.

The installation method of the bent cap for mutually restraining the adjacent pier studs in the prefabricated and assembled bridge provided by the disclosure further includes the following. Both the pier stud metal bellow and the cup metal bellow adopt galvanized metal bellows. A thickness of the annular grouting chamber is 50 mm, and a thickness of the bottom plane grouting chamber is 20 mm.

Compared to the related art, advantages of the disclosure include the following.

1. The bent cap mold base is configured in the form of the bent cap in the disclosure. In the installation process, the cap bent mold base is hoisted on the top portions of the adjacent two prefabricated pier studs, such that the pier stud pre-embedded steel bars protruding from the top portions of the two prefabricated pier studs are correspondingly inserted into the steel bar sleeves at the two ends of the bent cap mold base one by one. The adjacent two prefabricated pier studs are limited in the bent cap mold base, so that the degree of matching between the pier studs and the bent cap is effectively ensured through the form of mutual restraint of adjacent pier studs through the use of the bent cap mold base. The situation that the bent cap may not be aligned and installed is thus prevented from occurring, construction efficiency of bent cap installation is significantly improved, and engineering quality is also ensured.

2. The auxiliary adjustment mechanism is provided in the disclosure and is arranged to adjust the height and perpendicularity of each prefabricated pier stud. In this way, the perpendicularity and height of the prefabricated pier stud being placed into the bearing platform cup may be quickly and effectively adjusted.

3. A high-strength bonding surface is formed between the pier stud installation section and the socket of the pile top cup bearing platform by using the high-strength grouting material in the disclosure. In this way, consolidation between the pier stud installation section and the socket is achieved, the secondary wet connection of the cast-in-place concrete is avoided, and a quick construction process is provided.

4. Consolidation of the high-strength grouting material is implemented between the pier stud installation section whose outer circumferential surface is bellow-shaped and the socket whose stud chamber wall surface is bellow-shaped. In this way, the bonding force between the combined members is significantly improved, and the structure is ensured to be firm and stable.

5. The auxiliary adjustment mechanism and the bent cap mold base in the disclosure may be recycled after being removed, which is conducive to resource saving.

DESCRIPTION OF THE EMBODIMENTS

Description of the Embodiments

Figure 1:
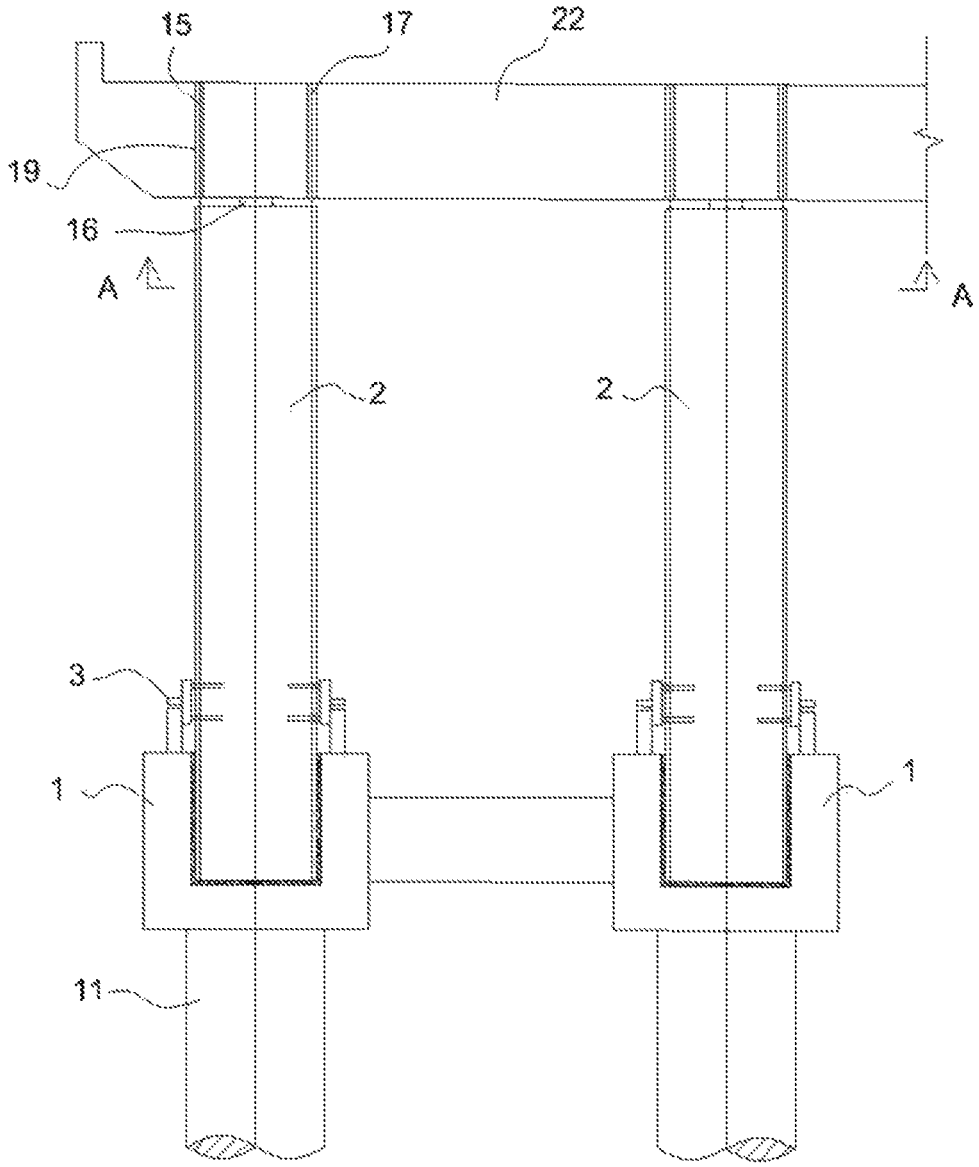
FIG. 1 is a schematic view of a structure formed by pier studs and a bent cap in the disclosure.
Figure 2:
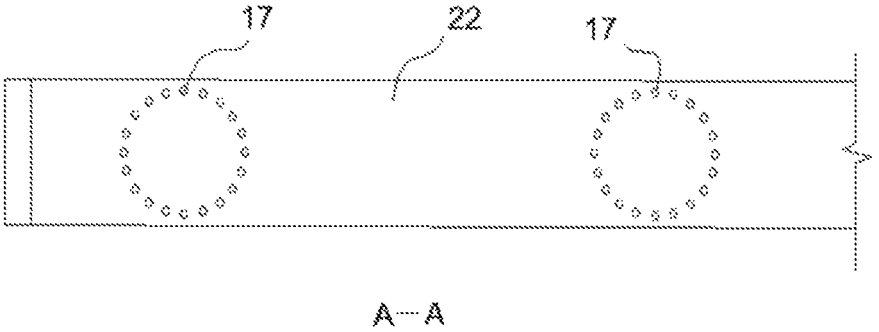
FIG. 2 is a schematic view of FIG. 1 taken along line A-A.

With reference to FIG. 1 and FIG. 2, in this embodiment, pier studs are prefabricated pier studs 2. A top portion of each of the prefabricated pier studs 2 is provided with protruding pier stud pre-embedded steel bars 15, and the pier stud pre-embedded steel bars 15 are evenly distributed into a circular ring shape on the top portion of each of the prefabricated pier studs 2 and form a pier stud pre-embedded steel bar ring with a radius r. A bent cap is a prefabricated bent cap 22, and two ends of the prefabricated bent cap 22 are respectively pre-embedded with bent cap pre-embedded sleeves 19. Steel bellows may be adopted to be used as the bent cap pre-embedded sleeves 19, and the use of the bellow structure may further enhance bonding and firmness between the pier stud pre-embedded steel bars 15 and the bent cap pre-embedded sleeves 19. Vertical grouting ducts 17 are provided on a top portion of the prefabricated bent cap 22 to communicate with the steel bar connection sleeves 19, and the bent cap pre-embedded sleeves 19 on the two ends of the prefabricated bent cap are evenly distributed into a circular ring shape at each end to form a bent cap pre-embedded sleeve ring with a radius r. The bent cap pre-embedded sleeves 19 in the bent cap pre-embedded sleeve ring correspond to the pier stud pre-embedded steel bars 15 in the pier stud pre-embedded steel bar ring one to one, such that the pier stud pre-embedded steel bars 15 may be inserted into the bent cap pre-embedded sleeves 19 of corresponding positions for anchorage.

Figure 3:
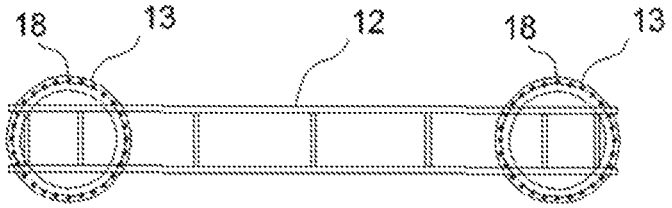
FIG. 3 is a schematic view of a bent cap mold base in the disclosure.

With reference to FIG. 1, FIG. 2, and FIG. 3, a bent cap mold base in this embodiment is configured as follows.

Limiting steel rings 13 are fixedly arranged at two ends of a rectangular frame 12 of a steel structure, and steel bar sleeves 18 are vertically arranged in the limiting steel rings 13. The steel bar sleeves 18 are evenly distributed into a circular ring shape in each limiting steel ring 13 and form a steel bar sleeve ring with a radius r. A center-to-center distance of the steel bar sleeve rings at the two ends and a center-to-center distance of the bent cap pre-embedded sleeve rings at the two ends in the prefabricated bent cap are set to be identical. Positions of the steel bar sleeves 18 in the steel bar sleeve ring are set to correspond to positions of the bent cap pre-embedded sleeves 19 in the bent cap pre-embedded sleeve ring of the corresponding end one to one.

An installation method of a bent cap for mutually restraining adjacent pier studs in a prefabricated and assembled bridge provided by this embodiment is performed in constructed pile top cup bearing platforms 1 through the following steps.

In step 1, the pile top cup bearing platforms 1 are formed on pile foundations 11, the prefabricated pier studs 2 are placed in two adjacent pile top cup bearing platforms 1 through hoisting, and a center distance and a plane position between the two prefabricated pier studs 2 are preliminarily adjusted.

In step 2: the cap bent mold base is hoisted on the top portions of the two prefabricated pier studs 2, such that the pier stud pre-embedded steel bars 15 protruding from the top portions of the two prefabricated pier studs are correspondingly inserted into the steel bar sleeves 18 at two ends of the bent cap mold base one by one. If the pier stud pre-embedded steel bars 15 in the two prefabricated pier studs and the steel bar sleeves 18 at the two ends of the bent cap mold base are not aligned due to deviation, the prefabricated pier studs are lifted again by a crane, the center distance and/or the plane position between the two prefabricated pier studs are readjusted until the pier stud pre-embedded steel bars 15 in the two prefabricated pier studs are correspondingly inserted into the vertical sleeves at the two ends of the bent cap mold base one by one, such that the adjacent two prefabricated pier studs 2 are limited in the bent cap mold base based on design needs.

In step 3, heights and perpendicularity of the adjacent two prefabricated pier studs 2 are adjusted to satisfy the design needs, and the prefabricated pier studs 2 are kept in a state which satisfies the design needs.

In step 4, anchorage is performed between each of the pile top cup bearing platforms 1 and the corresponding prefabricated pier stud 2 to complete assembly of the prefabricated pier studs 2.

In step 5, the bent cap mold base is removed, the bent cap mold base is replaced with the bent cap, steel backing plates 16 are placed between the top portions of the pier studs and the bent cap, and the pier stud pre-embedded steel bars 15 protruding from the top portions of the prefabricated pier studs are inserted into the bent cap pre-embedded sleeves 19 pre-embedded in the bent cap one by one.

In step 6, grouting is performed through the grouting ducts 17 on the bent cap, anchorage is performed between the prefabricated pier studs 2 and the prefabricated bent cap 22, and assembly of the prefabricated bent cap 22 is thus completed.

In specific implementation, step 3 further includes the following step. An auxiliary adjustment mechanism is arranged to adjust the height and perpendicularity of each prefabricated pier stud 2.

Figure 4:
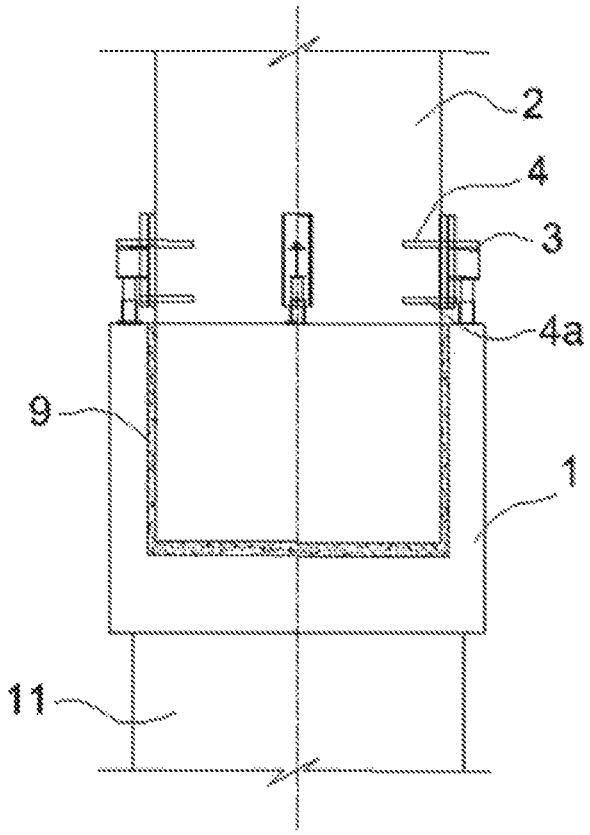
FIG. 4 is a schematic front view of an auxiliary adjustment mechanism in the disclosure.
Figure 5:
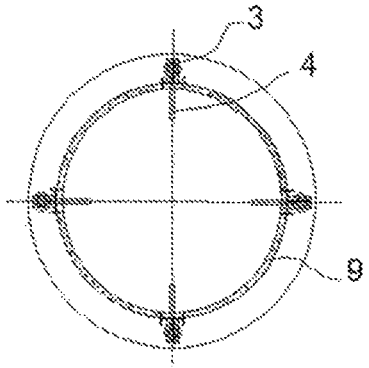
FIG. 5 is a schematic top view of the auxiliary adjustment mechanism in the disclosure.
Figure 6:
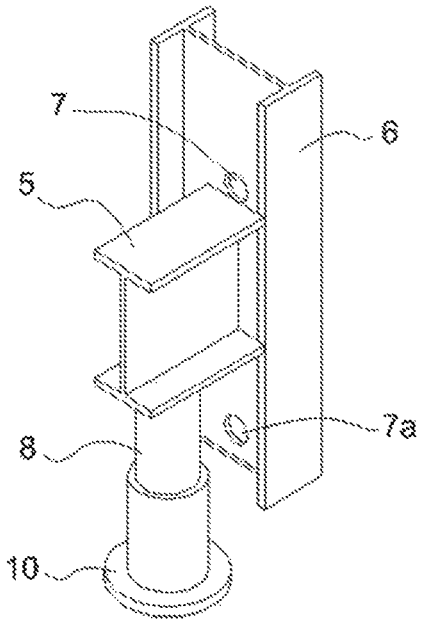
FIG. 6 is a schematic view of a structure of a reaction frame in the disclosure.

A structure of the auxiliary adjustment mechanism shown in FIG. 4, FIG. 5, and FIG. 6 is that: top support mechanisms are arranged between a top surface of each pile top cup bearing platform 1 and an outer side wall of each prefabricated pier stud 2. The top support mechanisms are evenly distributed in at least three groups around the outer side wall of the prefabricated pier stud 2. Each group of the top support mechanisms may independently adjust a top support height thereof, and adjustment of the height and/or perpendicularity of the pier stud 2 is achieved through adjusting the top support height of the top support mechanisms of one group or plural groups. In this embodiment, four groups of the top support mechanisms distributed in a cross shape are provided, and the top support mechanisms at four positions may independently adjust their respective top support heights. According to spatial position information of the prefabricated pier stud 2 fed back by a total station, the top support heights of the top support mechanisms at the corresponding positions are adjusted, such that the pier stud may meet the perpendicularity and height requirements, and spatial position of the pier stud may be ensured to be accurate.

A structure of each of the top support mechanisms is that a jack 8 is provided on the top surface of each pile top cup bearing platform 1. A reaction frame 3 having a horizontal support surface is provided on a corresponding position of the outer side wall of the prefabricated pier stud 2, and the jack 8 is supported between the top surface of the pile top cup bearing platform 1 and the support surface of the reaction frame 3.

As shown in FIG. 6, the reaction frame 3 is formed by a vertical universal beam 6 and a horizontal universal beam 5. The vertical universal beam 6 is attached to the outer side wall of the prefabricated pier stud 2 and is attached to the outer side wall of the prefabricated pier stud 2 through flange slabs separately disposed on two sides of a web of the vertical universal beam 6. One end of the horizontal universal beam 5 abuts against the web of the vertical universal beam 6 and is fixedly connected to the vertical universal beam 6, and a bottom surface of a lower flange slab in the horizontal universal beam 5 is the support surface of the reaction frame 5.

Figure 7:
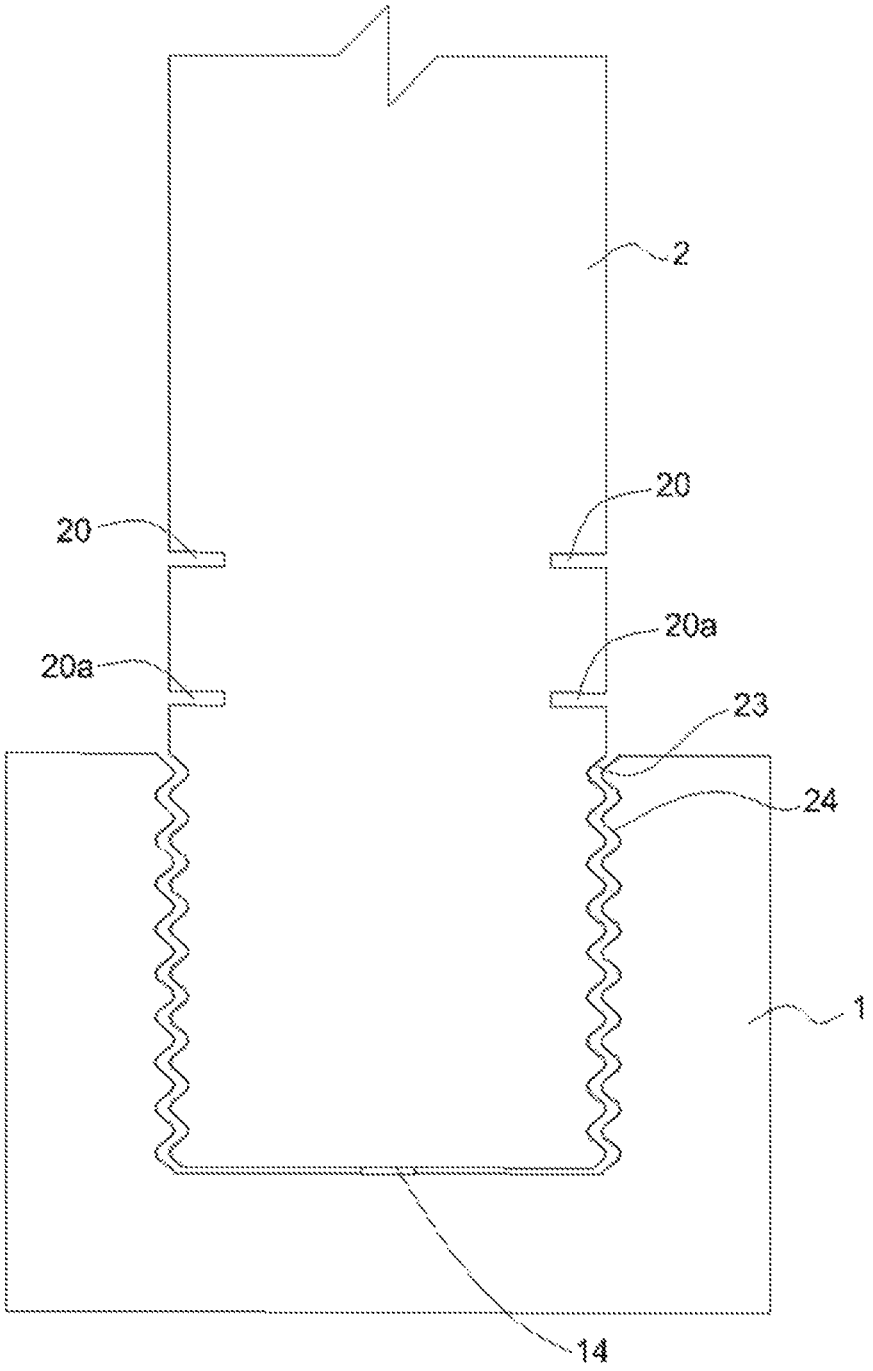
FIG. 7 is a schematic view of a matching structure between a pile top cup bearing platform and a prefabricated pier stud in the disclosure.

A fixed structure of the arranged reaction frame 3 is that: a web reserved hole 7 is provided on the web of the vertical universal beam 6. As shown in FIG. 7, pier stud reserved holes 20 are radially and horizontally arranged in the prefabricated pier stud 2. One end of a steel rod 4 is inserted into one of the pier stud reserved holes 20, and the other end of the steel rod 4 penetrates through the web reserved hole 7 in the vertical universal beam 6 and is disposed on a top surface of an upper flange slab of the horizontal universal beam 5.

In specific implementation, in order to provide structural stability, the fixed structure of the reaction frame 3 is further provided with a lower-layer fixed structure formed by: a lower-layer web reserved hole 7*a*, lower-layer pier stud reserved holes 20*a*, and a lower-layer steel rod 4*a*. The lower-layer fixed structure is located at a position that does not interfere with the horizontal universal beam 5. One end of the lower-layer steel rod 4*a* is inserted into one of the lower-layer pier stud reserved holes 20*a* of the prefabricated pier stud, and the other end of the lower-layer steel rod 4*a* is directly disposed in the lower-layer web reserved hole 7*a* in the vertical universal beam 6.

In addition, a center of the jack 8 should be as close as possible to the prefabricated pier stud 2 when operating conditions are met, so as to reduce concrete damage when the steel rod is inserted into a mouth portion. A circular pad 10 with a larger area than that of a bottom portion of the jack 8 may be placed on the bottom portion of the jack 8, so that a force may be evenly received.

In this embodiment, the step of performing anchorage between each of the pile top cup bearing platforms 1 and the corresponding prefabricated pier stud 2 in step 4 further includes the following steps.

As shown in FIG. 7, a pier stud metal bellow 23 is pre-embedded on an outer circumferential surface of a lower section of the prefabricated pier stud 2, and a pier stud installation section whose outer circumferential surface is bellow-shaped is formed. In a cup mouth of each pile top cup bearing platform 1, a cup metal bellow 24 is pre-embedded on a wall surface of a stud chamber, and a socket whose stud chamber wall surface is bellow-shaped. A central steel pad 14 with a protruding thickness of 20 mm is pre-embedded on a bottom surface of the stud chamber. The pier stud installation section is placed in the socket, an annular grouting chamber is formed between circumferential surfaces of each other, and a bottom plane grouting chamber is formed on a bottom surface. A high-strength grouting material is injected in the annular grouting chamber and the bottom plane grouting chamber to form a consolidation surface 9 to achieve the anchorage between the pile top cup bearing platform 1 and the corresponding prefabricated pier stud 2. Both the pier stud metal bellow and the cup metal bellow adopt galvanized metal bellows. A thickness of the annular grouting chamber is 50 mm, and a thickness of the bottom plane grouting chamber is 20 mm. The high-strength grouting material is CGM-2 high-strength non-shrinkage grouting material, and a water-to-material ratio is 12% during mixing.

The installation method of the bent cap for mutually restraining the adjacent pier studs in the prefabricated and assembled bridge provided by the disclosure is verified in the assembly construction of the assembly-type pier studs and bent caps of the reconstruction and expansion project of the Tai'an to Zaozhuang (Lu-Sujie) section of the Jingtai Expressway. The success rate of one-time assembly construction of pier studs and bent caps reaches 100%, and the construction efficiency is significantly improved. Construction difficulty of difficult construction matching and low accuracy found in assembly construction of prefabricated circular pier studs and prefabricated bent caps is effectively prevented, and a good application prospect is provided in the same type of assembly construction.

What is claimed is:

1. An installation method of a bent cap for mutually restraining adjacent pier studs in a prefabricated and assembled bridge, characterized in that:

the pier studs are prefabricated pier studs, a top portion of each of the prefabricated pier studs is provided with pier stud pre-embedded steel bars, the pier stud pre-embedded steel bars are evenly distributed into a circular ring shape on the top portion of each of the prefabricated pier studs and form a pier stud pre-embedded steel bar ring with a radius r;

the bent cap is a prefabricated bent cap, two ends of the prefabricated bent cap are respectively pre-embedded with bent cap pre-embedded sleeves, vertical grouting ducts are provided on a top portion of the prefabricated bent cap and are in communication with the bent cap pre-embedded sleeves, the bent cap pre-embedded sleeves on the two ends of the prefabricated bent cap are evenly distributed into a circular ring shape at each end to form a bent cap pre-embedded sleeve ring with a radius r; and the bent cap pre-embedded sleeves in the bent cap pre-embedded sleeve ring correspond to the pier stud pre-embedded steel bars in the pier stud pre-embedded steel bar ring one to one, such that the pier stud pre-embedded steel bars are able to be inserted into the bent cap pre-embedded sleeves of corresponding positions for anchorage;

a bent cap mold base is configured as follows:

fixedly arranging limiting steel rings at two ends of a rectangular frame, and vertically arranging steel bar sleeves in the limiting steel rings, wherein the steel bar sleeves are evenly distributed into a circular ring shape in each of the limiting steel rings and form a steel bar sleeve ring with a radius r; setting a center-to-center distance of the steel bar sleeve rings at the two ends and a center-to-center distance of the bent cap pre-embedded sleeve rings at the two ends in the prefabricated bent cap to be identical; and setting positions of the steel bar sleeves in the steel bar sleeve ring to correspond to positions of the bent cap pre-embedded sleeves in the bent cap pre-embedded sleeve ring of the corresponding end one to one;

the installation method of the bent cap is performed in constructed pile top cup bearing platforms through the following steps:

step 1: through hoisting, placing the prefabricated pier studs in two adjacent pile top cup bearing platforms, respectively, and preliminarily adjusting a center distance and a plane position between the two prefabricated pier studs;

step 2: hoisting the cap bent mold base on the top portions of the two prefabricated pier studs, such that the pier stud pre-embedded steel bars protruding from the top portions of the two prefabricated pier studs are correspondingly inserted into the steel bar sleeves at two ends of the bent cap mold base one by one; and when the pier stud pre-embedded steel bars in the two prefabricated pier studs and the steel bar sleeves at the two ends of the bent cap mold base are not aligned due to deviation, lifting the prefabricated pier studs again by a crane and readjusting the center distance and/or the plane position between the two prefabricated pier studs until the pier stud pre-embedded steel bars in the two prefabricated pier studs are correspondingly inserted into the vertical steel bar sleeves at the two ends of the bent cap mold base one by one, such that the adjacent two prefabricated pier studs are limited in the bent cap mold base;

step 3: adjusting heights and perpendicularity of the adjacent two prefabricated pier studs to satisfy design needs, and keeping the prefabricated pier studs in a state which satisfies the design needs;

step 4: performing anchorage between each of the pile top cup bearing platforms and the corresponding prefabricated pier stud to complete assembly of the prefabricated pier studs;

step 5: removing the bent cap mold base, replacing the bent cap mold base with the bent cap, and inserting the pier stud pre-embedded steel bars protruding from the top portions of the prefabricated pier studs into the bent cap pre-embedded sleeves pre-embedded in the bent cap one by one; and step 6: performing grouting through the grouting ducts on the bent cap, performing anchorage between the prefabricated pier studs and the prefabricated bent cap, and completing assembly of the prefabricated bent cap.

2. The installation method of the bent cap for mutually restraining the adjacent pier studs in the prefabricated and assembled bridge according to claim 1, wherein:

in step 3, arranging an auxiliary adjustment mechanism to adjust the height and perpendicularity of each prefabricated pier stud, wherein a structure of the auxiliary adjustment mechanism is that top support mechanisms are arranged between a top surface of each pile top cup bearing platform and an outer side wall of each prefabricated pier stud, the top support mechanisms are evenly distributed in at least three groups around the outer side wall of the prefabricated pier stud, each group of the top support mechanisms is able to independently adjust a top support height thereof, and adjustment of the height and/or the perpendicularity of the prefabricated pier stud is achieved through adjusting the top support height of the top support mechanisms of one group or plural groups.

3. The installation method of the bent cap for mutually restraining the adjacent pier studs in the prefabricated and assembled bridge according to claim 2, wherein a structure of each of the top support mechanisms is that a jack is provided on the top surface of each pile top cup bearing platform, a reaction frame having a horizontal support surface is provided on a corresponding position of the outer side wall of each prefabricated pier stud, and the jack is supported between the top surface of the pile top cup bearing platform and the support surface of the reaction frame.

4. The installation method of the bent cap for mutually restraining the adjacent pier studs in the prefabricated and assembled bridge according to claim 3, wherein the reaction frame is formed by a vertical universal beam and a horizontal universal beam, the vertical universal beam is attached to the outer side wall of the prefabricated pier stud and is attached to the outer side wall of the prefabricated pier stud through flange slabs separately disposed on two sides of a web of the vertical universal beam, one end of the horizontal universal beam abuts against the web of the vertical universal beam and is fixedly connected to the vertical universal beam, and a bottom surface of a lower flange slab in the horizontal universal beam is the support surface of the reaction frame.

5. The installation method of the bent cap for mutually restraining the adjacent pier studs in the prefabricated and assembled bridge according to claim 4, wherein a fixed structure of the reaction frame is that a web reserved hole is provided on the web of the vertical universal beam, pier stud reserved holes are radially and horizontally arranged in each prefabricated pier stud (2), one end of a steel rod is inserted into one of the pier stud reserved holes, and the other end of the steel rod penetrates through the web reserved hole in the vertical universal beam and is disposed on a top surface of an upper flange slab of the horizontal universal beam.

6. The installation method of the bent cap for mutually restraining the adjacent pier studs in the prefabricated and assembled bridge according to claim 5, wherein the fixed structure of the reaction frame is further provided with a lower-layer fixed structure formed by a lower-layer web reserved hole, lower-layer pier stud reserved holes, and a lower-layer steel rod, wherein the lower-layer fixed structure is located at a position that does not interfere with the horizontal universal beam, one end of the lower-layer steel rod is inserted into one of the lower-layer pier stud reserved holes of the prefabricated pier stud, and the other end of the lower-layer steel rod is directly disposed in the lower-layer web reserved hole in the vertical universal beam.

7. The installation method of the bent cap for mutually restraining the adjacent pier studs in the prefabricated and assembled bridge according to claim 1, wherein:

performing anchorage between each of the pile top cup bearing platforms and the corresponding prefabricated pier stud in step 4 comprises the following steps:

pre-embedding a pier stud metal bellow on an outer circumferential surface of a lower section of the prefabricated pier stud, and forming a pier stud installation section having an outer circumferential surface being bellow-shaped;

pre-embedding a cup metal bellow on a wall surface of a stud chamber in a cup mouth of each pile top cup bearing platform, forming a socket having a stud chamber wall surface being bellow-shaped, and pre-embedding a central steel pad (14) on a bottom surface of the stud chamber; and placing the pier stud installation section in the socket, forming an annular grouting chamber between circumferential surfaces of each other, forming a bottom plane grouting chamber on a bottom surface, and injecting a high-strength grouting material in the annular grouting chamber and the bottom plane grouting chamber to achieve the anchorage between the pile top cup bearing platform and the corresponding prefabricated pier stud.

8. The installation method of the bent cap for mutually restraining the adjacent pier studs in the prefabricated and assembled bridge according to claim 7, wherein both the pier stud metal bellow and the cup metal bellow adopt galvanized metal bellows, a thickness of the annular grouting chamber is 50 mm, and a thickness of the bottom plane grouting chamber is 20 mm.

* * * * *